US011002052B2

(12) United States Patent
Terno

(10) Patent No.: US 11,002,052 B2
(45) Date of Patent: May 11, 2021

(54) SLIDING DEVICE FOR DOORS AND WARDROBE DOORS PROVIDED WITH MULTIPLE ADJUSTMENTS

(71) Applicants: TERNO SCORREVOLI S.P.A. UNIPERSONALE, Varedo (IT); Nicola Ballotta, Marano Sul Panaro (IT)

(72) Inventor: Giovanni Terno, Varedo (IT)

(73) Assignees: TERNO SCORREVOLI S.P.A. UNIPERSONALE, Varedo (IT); Nicola Ballotta, Marano Sul Perano (IT)

( * ) Notice: Subject to any disclaimer, the term of this patent is extended or adjusted under 35 U.S.C. 154(b) by 0 days.

(21) Appl. No.: 16/605,864

(22) PCT Filed: Jul. 9, 2018

(86) PCT No.: PCT/EP2018/000348
§ 371 (c)(1),
(2) Date: Oct. 17, 2019

(87) PCT Pub. No.: WO2019/015797
PCT Pub. Date: Jan. 24, 2019

(65) Prior Publication Data

US 2020/0224473 A1 Jul. 16, 2020

(30) Foreign Application Priority Data

Jul. 19, 2017 (IT) ..... 102017000081786

(51) Int. Cl.
*E05D 15/00* (2006.01)
*E05D 15/06* (2006.01)

(52) U.S. Cl.
CPC ..... *E05D 15/0621* (2013.01); *E05Y 2900/20* (2013.01)

(58) Field of Classification Search
CPC ..... E05D 15/00; E05D 15/1005; E05D 15/28; E05D 15/0608; E05D 15/0621;
(Continued)

(56) References Cited

U.S. PATENT DOCUMENTS 2,940,113 A * 6/1960 Riser ..... E05D 15/063 16/105
3,118,170 A * 1/1964 Zollinger ..... E05D 15/063 16/105
(Continued)

FOREIGN PATENT DOCUMENTS

FR 46590 E 7/1936
JP 10205208 A * 8/1998
(Continued)

OTHER PUBLICATIONS

International Search Report, dated Jan. 10, 2018 for corresponding PCT patent application No. PCT/EP2018/000348.
(Continued)

*Primary Examiner* — Chuck Y Mah
(74) *Attorney, Agent, or Firm* — Abelman, Frayne & Schwab; Stefan Knirr

(57) ABSTRACT

A sliding device for doors and (24) wardrobe doors provided with multiple adjustments consists of a carriage or slider (10), provided with rollers or bearings (22) for sliding the doors to which a profile section (28) is secured having an embossed and shaped portion (22^ of a shape complementary to the profile section of said rollers (22). The carriage or slider (10) comprises a first body or front body (12), having a substantially rectangular plan, and a second body or rear body (14) intended to be connected to the first front body (12); said rear body (14) is provided with opposed substantially cylindrical appendages (16, 18) with a vertical passing-through hole (32) in which respective cylindrical bodies are inserted along which an offset and passing-through
(Continued)

threaded hole (36) is bored, to form as many eccentrics (34). In each of the holes (36) a threaded stem or screw (38) is entered, which protrudes from the upper side of the front body (12) on which corresponding holes or slots (32*y*) are bored.

12 Claims, 7 Drawing Sheets

(58) Field of Classification Search
CPC ... E05D 15/0626; E05D 15/264; E05D 15/06; E05D 15/063; E05D 15/0643; E05D 15/0647; E05D 15/165; E05D 15/0653; E05D 15/26; E05D 15/262; E05Y 2201/64; E05Y 2201/688; E05Y 2201/708; E05Y 2201/612; E05Y 2201/614; E05Y 2900/531; E05Y 2900/532; E05Y 2900/20; E05Y 2900/131; E05Y 2900/132; E05Y 2900/142; B60J 5/06; B60J 5/062; B60J 5/047; B60J 5/12; B60J 5/04; Y10T 16/364; Y10T 16/3813; Y10T 16/3837; Y10T 16/384; Y10T 16/3825; A47H 2023/025; A47H 1/04; A47H 15/00; A47H 15/02; A47H 15/04; E06B 3/50; E06B 3/485; E06B 9/36; E06B 3/42; E06B 3/46; E06B 3/4609; E06B 3/4636
See application file for complete search history.

(56) References Cited

U.S. PATENT DOCUMENTS 4,651,469 A * 3/1987 Ngian ..... E05D 15/1021 16/87 R
6,418,588 B1 * 7/2002 Haab ..... E05D 15/063 16/91
6,698,138 B1 * 3/2004 Lin ..... E05D 15/0639 16/105
8,046,872 B2 * 11/2011 Burgess ..... E05D 15/0639 16/97
8,950,041 B2 * 2/2015 Palsson ..... B23P 6/00 16/102
9,091,106 B2 * 7/2015 Allen ..... E05D 15/063
9,290,977 B2 * 3/2016 Haab ..... E05D 15/0652
9,458,654 B2 * 10/2016 Palsson ..... E05D 15/0634
9,915,087 B2 * 3/2018 Kreyenborg ..... E05D 15/0691
2004/0098831 A1 * 5/2004 Elmer ..... E05D 15/063 16/89
2005/0011041 A1 * 1/2005 Ness ..... E05D 15/0669 16/105
2007/0017065 A1 * 1/2007 Hutnik ..... E05D 15/0669 16/91
2007/0130725 A1 * 6/2007 Ness ..... E05D 15/0669 16/105
2010/0269291 A1 * 10/2010 Haab ..... E06B 3/5045 16/91
2011/0041286 A1 * 2/2011 Busch ..... E05F 15/632 16/91
2013/0042534 A1 * 2/2013 Polus ..... E05D 15/0686 49/425
2017/0298669 A1 * 10/2017 Boring ..... E05D 15/0626
2018/0058122 A1 * 3/2018 Lang ..... E05D 15/0669

FOREIGN PATENT DOCUMENTS

JP 10205209 A * 8/1998
JP 2000291322 A * 10/2000
JP 2017214794 A * 12/2017
WO 2012073215 A1 6/2012

OTHER PUBLICATIONS

Written Opinion of the International Search Authority, dated Jan. 10, 2018 for corresponding PCT patent application No. PCT/EP2018/000348.

* cited by examiner

SLIDING DEVICE FOR DOORS AND WARDROBE DOORS PROVIDED WITH MULTIPLE ADJUSTMENTS

BACKGROUND OF THE INVENTION

This invention relates to a sliding device for doors provided with multiple adjustments.

More particularly, this invention relates to a device as defined above, especially suitable for the sliding movement of doors that alternatively close or make passage accessible between two adjacent areas or doors of wardrobes and furniture in general.

As is known, the sliding doors that separate two areas are often used based on their practicality, since they do not require cantilevering spaces for opening and, in certain solutions, they are entered in a hidden position on both sides of the wall. Even from an aesthetic point of view, the sliding doors are therefore appreciated and increasingly widespread, both in residential areas and in offices and commercial premises. To allow the sliding of these doors, specific devices are used, comprising carriages that are moved along an upper guide secured to the wall and, at the same time, secured to the upper end or header of the door to be moved; the connection between the carriages and the door is generally achieved through an appendage integral with the lower part of each carriage, which projects from a slot extending longitudinally in the above-mentioned guide. Said appendage includes on its free end a plate or the like, which by means of screws or equivalent retaining means is constrained to the door. A solution of this type is described in the EP 2 913.468 patent of the same applicant.

As an alternative, the door is provided, on the internal side facing the wall, with a shaped profile section whose upper part defines a contoured profile section complementary to that of a pair of wheels or rollers of a fixed carriage, i.e. secured to the wall, to be precisely hooked to said rollers; in this case, the opening and closing movement of the door takes place according to the sliding of the profile section on the wheels or rollers of the fixed carriage; this solution is particularly advantageous since the device as a whole is hidden from view, except for a plastic cap that closes the headers of the profile section. In both hypotheses, a complementary and opposed lower guide completes the device; said lower guide is screwed to the floor and includes a projecting appendage such as a pin or the like that engages along a slot formed at the lower end of the door. These known devices for sliding doors, although capable of performing the function to which they are designed, however, exhibit some drawbacks, connected above all to the adjustment of the carriages during installation. In this regard, an important adjustment concerns the distance of the door from the wall and is necessary if it does not present a perfectly planar development but includes one or more embossed or recessed areas with respect to others. In these cases, it is necessary to use spacers, which are interposed between the wall and the fixed carriage, on which the shaped profile section integral with the inner side of the door moves when sliding; the positioning of such spacers, which have the purpose of keeping the door for its entire width homogeneously spaced from the wall, is complex and laborious, since it requires the release of the door with respect to the carriage. This adjustment is also approximate and a further difficulty is encountered when positioning three spacers in correspondence with the three wall securing screws of the carriage without letting them fall to the ground. Finally, the fact of having a support of the fixed carriage located on the spacers does not guarantee an optimal stabilization of the carriage with respect to the wall.

The fixed carriages of the sliding devices, also called "sliders", are also provided with means for their adjustment in a vertical direction, that is to say with respect to the floor in which a guide for moving the door along the lower edge is generally integrated. Said vertical adjustment is obtained by means of a screw placed above the center of the carriage and may be difficult, being necessarily carried out prior to the insertion of the side caps that close the opposed headers of the profile section secured to the door, which, as explained above, is hooked and slides on the wheels of the carriage bound to the wall. It is also necessary, in order to perform the aforementioned vertical adjustment, that the door is open and in an end-of-stroke position.

The purpose of this invention is to obviate the disadvantages mentioned above.

WO 2012 073215 discloses the manufacture solution of a sliding door comprising a shutter able to move between two end opening and closing positions; said door is provided with means for supporting and guiding the shutter, which, in turn, comprise rotating items for slidably supporting longitudinal guide devices, secured above the shutter itself and also associated with its lower edge.

The French patent no. FR 46590 describes instead a sliding door suspended on eccentric pins; on the door frame there are lateral rollers, eccentrically adjustable in the same manner as the suspension means, so as to be able to suitably adjust the vertical position of said door. This sliding guide solution aims to avoid vibrations and noises during door movement.

SUMMARY OF THE INVENTION

More particularly, the purpose of this invention is to provide a sliding device for doors or wardrobes and furniture in general that allows to adjust the distance of the door from the wall in an extremely simple and effective manner, without the need for unhooking the door itself from the fixed or sliding carriage and, therefore, avoiding the risks connected to any damage.

A further purpose of the invention is to provide a sliding device for doors and wardrobe doors in which the adjustment of the distance between the door and the wall can be carried out rapidly, with extreme precision and without resorting to the use of spacers.

A further purpose of the invention is to provide a sliding device for doors and wardrobe doors in which the adjustment of the fixed carriage in the vertical direction can be achieved with precision and in a simple manner, with the door at any point of the stroke and also with the side caps inserted on the opposite headers of the profile section bound to the door itself.

Not least purpose of the invention is to provide a sliding device for doors and wardrobe doors in which the traditional safety wheel is arranged in such a way as to avoid any risk of direct contact between the door and the wall.

A further purpose of the invention is to provide users with a sliding device for doors and wardrobe doors that is able to guarantee a high level of resistance and reliability over time, such as to be also easily and economically manufactured.

These and still other purposes are achieved by the sliding device for doors and wardrobe doors provided with multiple adjustments of this invention according to the main claim.

BRIEF DESCRIPTION OF THE DRAWINGS

The constructive and functional characteristics of the sliding device for doors and wardrobe doors of this invention can be better understood from the detailed description below, in which reference is made to the attached tables of drawings that represent a preferred and non-limiting embodiment thereof, referring to doors, and in which.

DETAILED DESCRIPTION OF THE INVENTION

Figure 1:
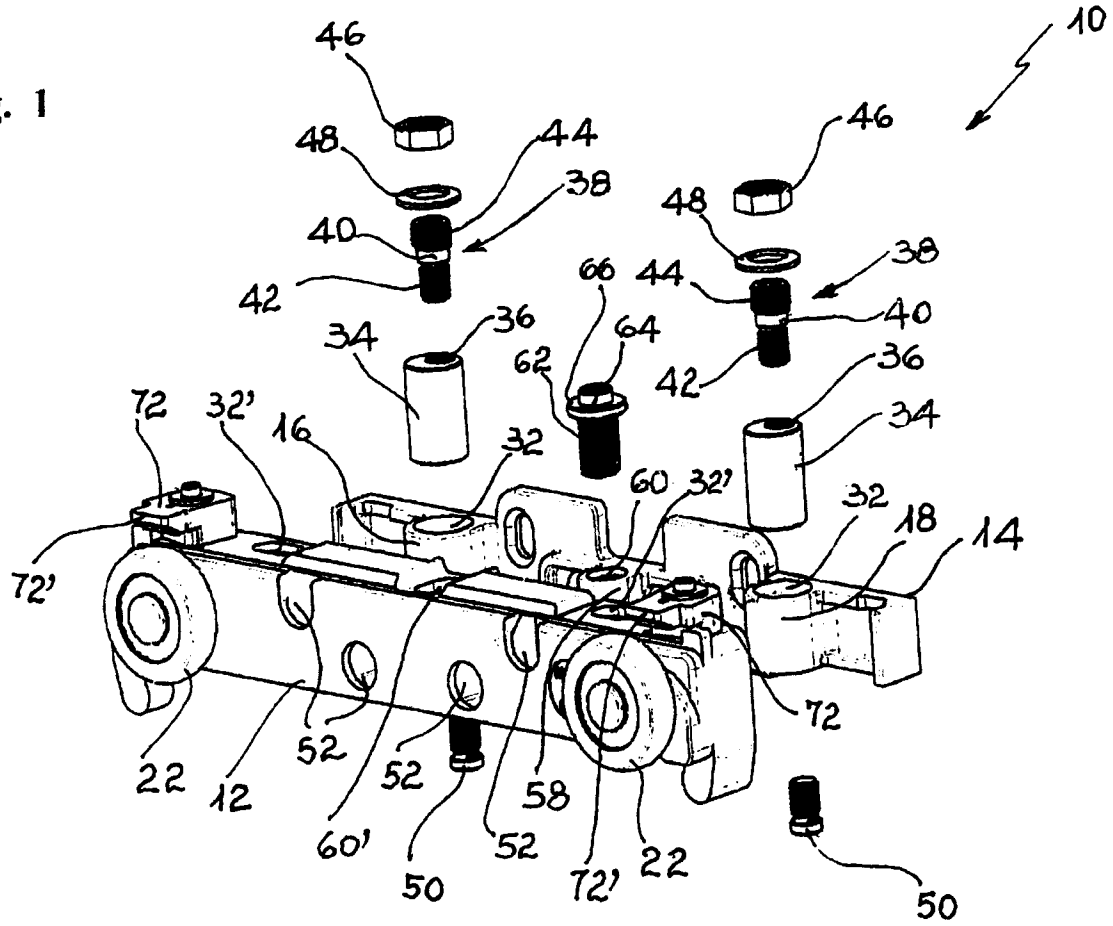
FIG. 1 shows schematically an exploded view from the front side of the carriage or slider intended to be secured to the wall.
Figure 2:
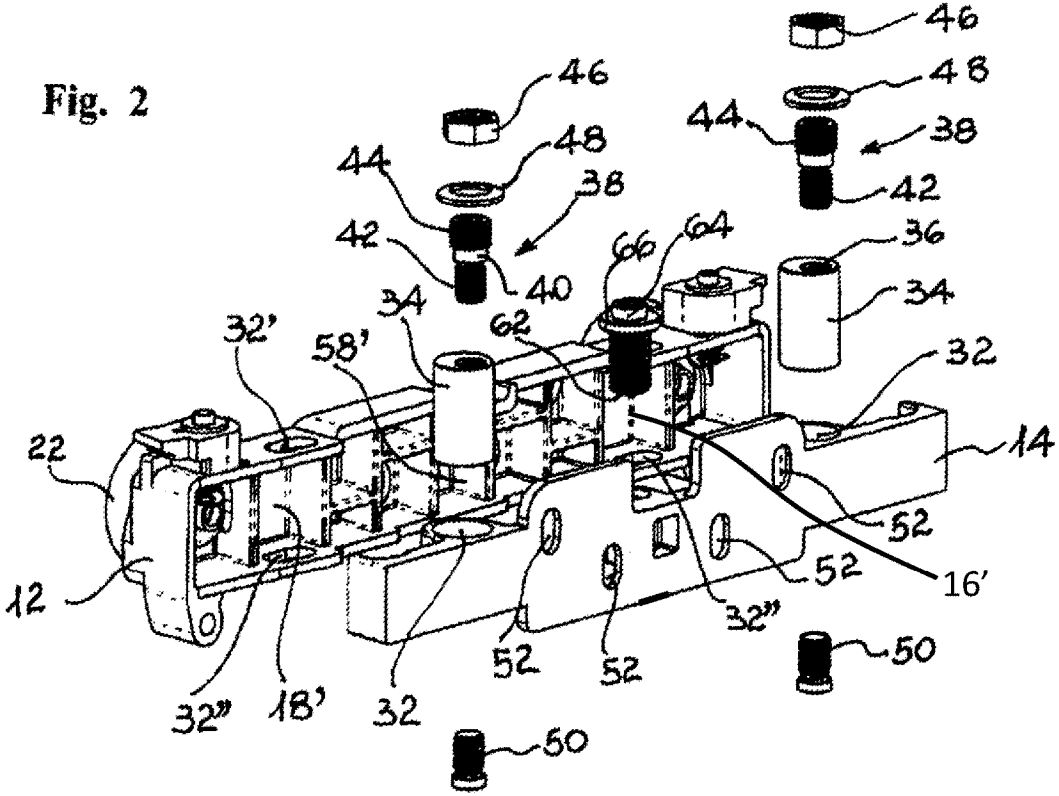
FIG. 2 shows schematically an exploded view from the rear side of the same carriage or slider intended to be secured to the wall.
Figure 3:
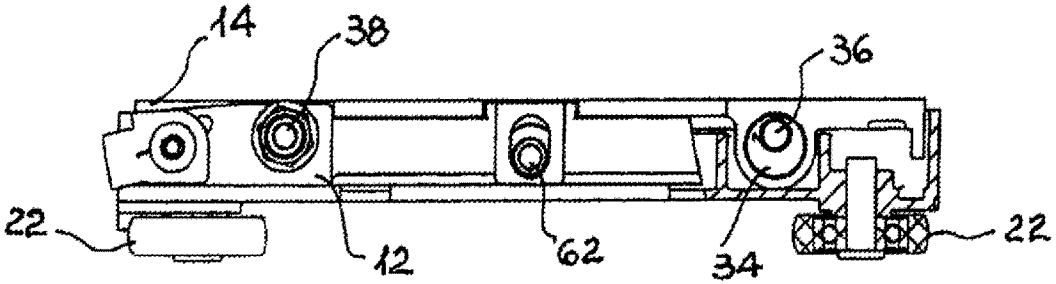
FIG. 3 shows schematically the same carriage in a partially sectioned top view.
Figure 4:
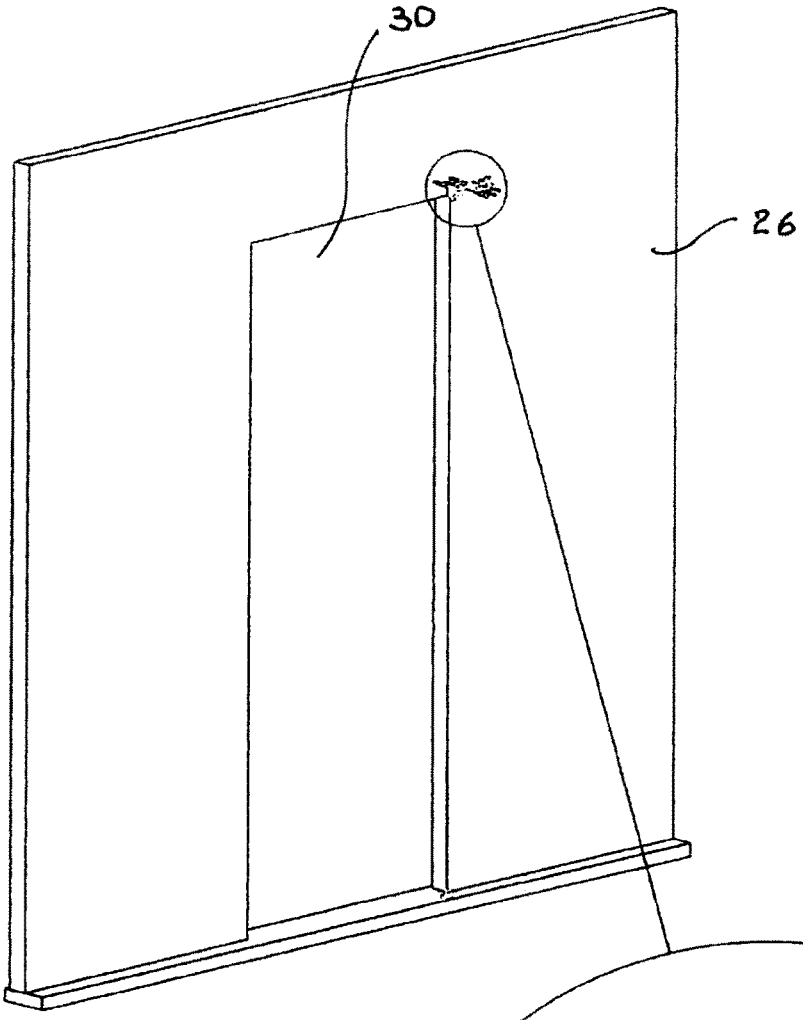
FIG. 4 shows schematically an axonometric view of the wall and of the passage space made thereon, with the carriage or slider in the condition preceding its securing to said wall.
Figure 4A:
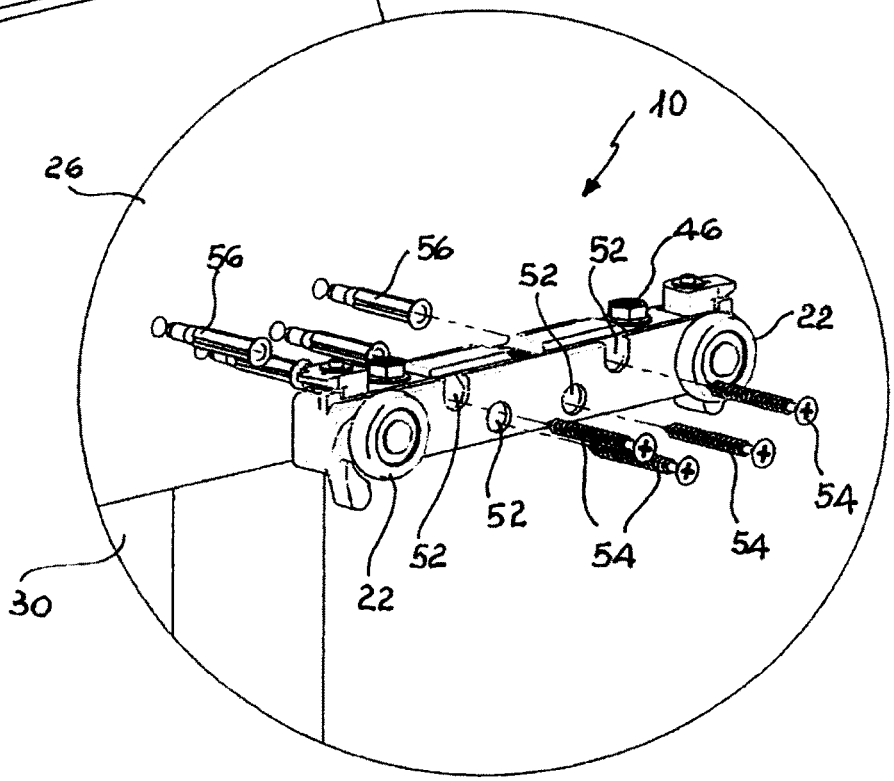
FIG. 4A is a partial magnification of FIG. 4.
Figure 5:
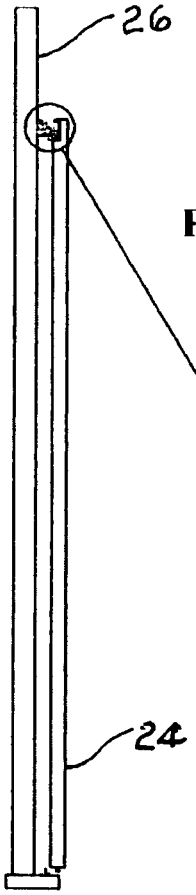
FIG. 5 shows schematically a side view of the wall provided with a carriage or slider and of the door in the condition preceding its engagement with said sliding device.
Figure 5A:
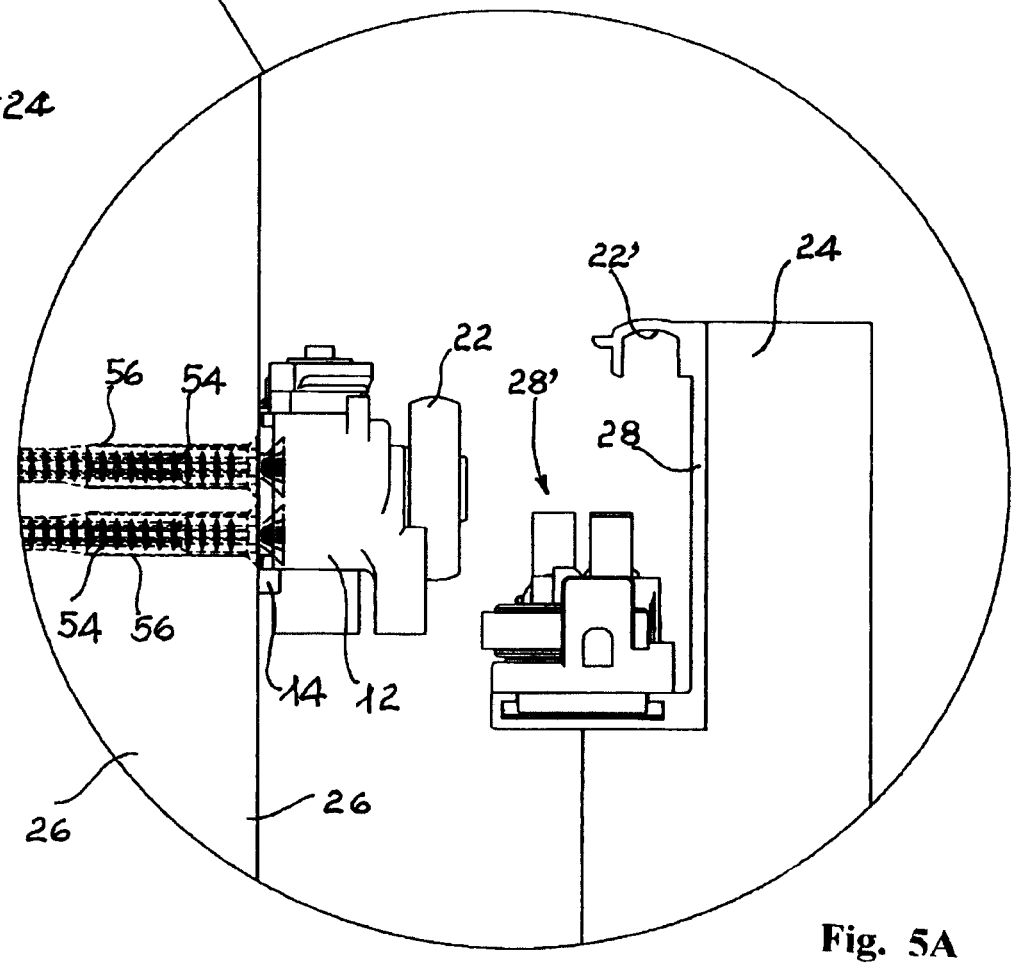
FIG. 5A is a partial magnification of FIG. 5.
Figures 6, 6A:
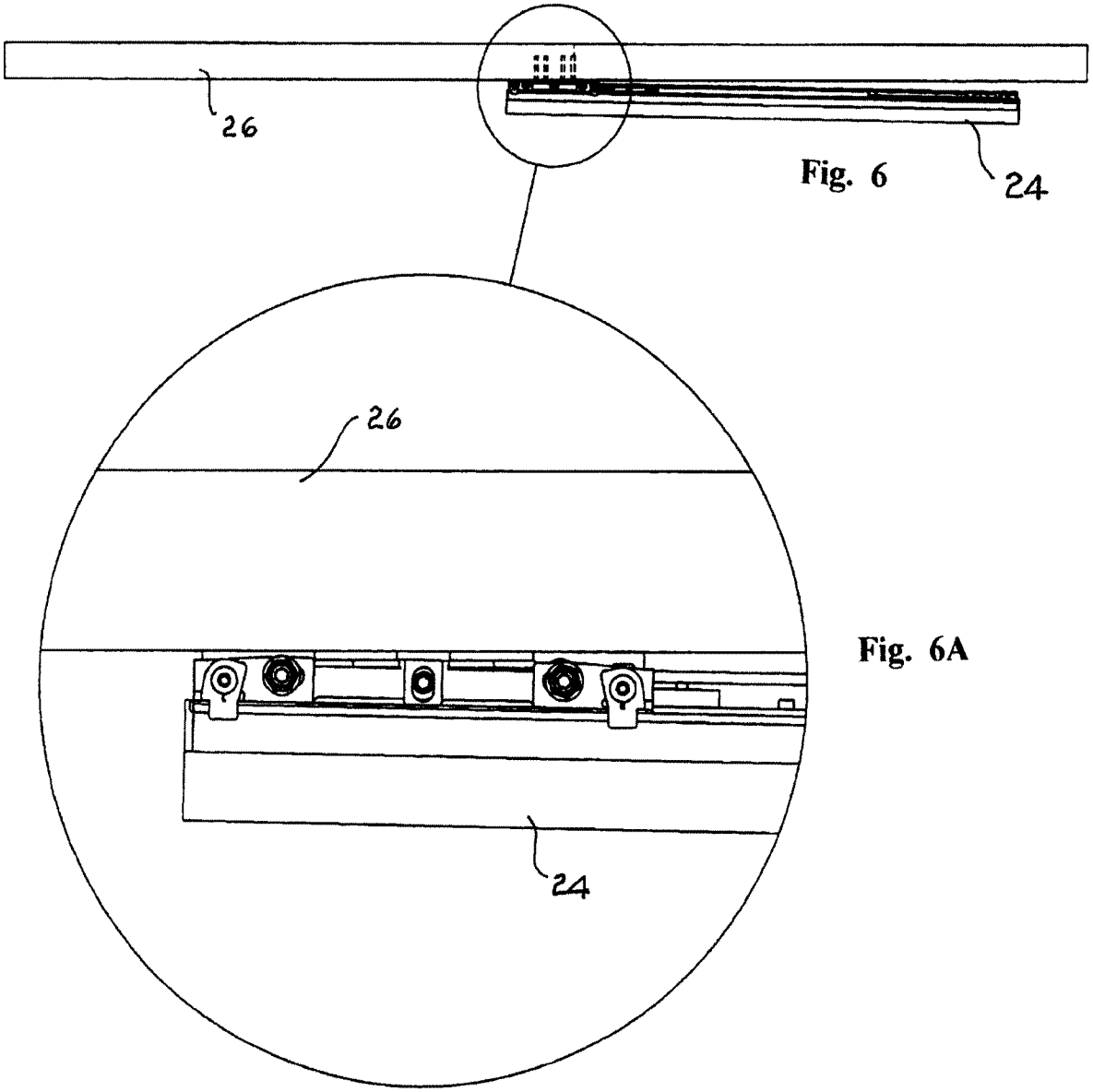
FIG. 6 shows schematically a top view of the wall and of the door mounted thereon, to highlight the irregular distance there may be between the door and the wall due to the lack of planarity of the wall itself.
FIG. 6A is a partial magnification of FIG. 6.
Figure 7:
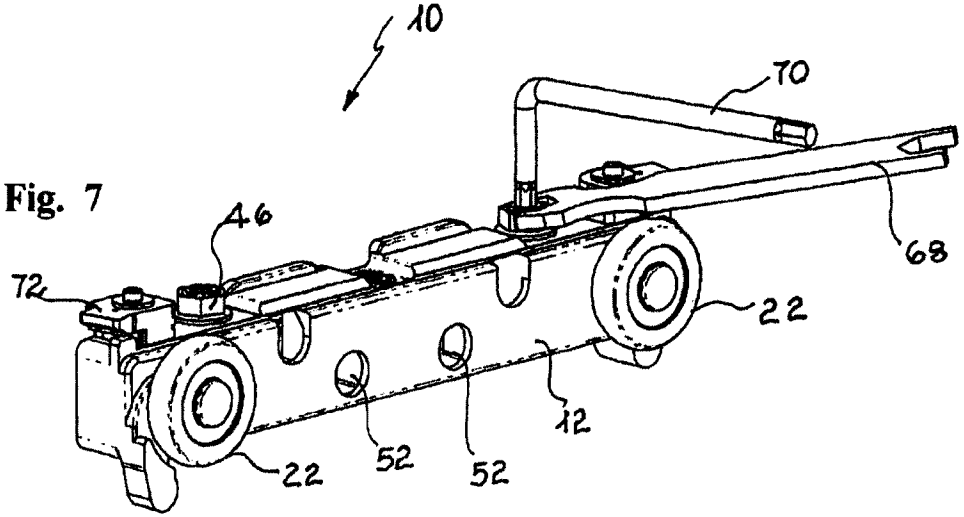
FIG. 7 shows schematically, in an axonometric view, one of the carriages or sliders on one side or front of which the intervention is carried out, by means of conventional operating keys, to compensate for the difference in height of the wall.

With the initial reference to FIGS. 1 to 4A, the sliding device for doors provided with multiple adjustments according to the invention defines a carriage or slider, indicated as a whole with 10 in FIGS. 1, 4A and 7, comprising a first body or front body 12, having a substantially rectangular plan, and a second rear body or body 14 intended to be connected to the first front body 12. The rear body 14 defines a plate-like development, as can be seen in FIG. 2, and comprises two opposite and integral substantially cylindrical appendages 16, 18 that protrude from its front end 20 facing the first body 12. The exposed front side of the first body 12 is provided with a pair of bearings or rollers 22, known in themselves, horizontally aligned and suitably spaced; on said rollers 22, with its own embossed and shaped portion 22' having a shape complementary to the profile section of the rollers themselves, a profile section 28 slides, secured to a side of the door schematized with 24 in FIGS. 5, 5A, 6, 6A; the door 24 is suitable for screening a passage space 30, as shown in FIGS. 4 and 4A, created along a wall. A device 28' (FIG. 5A) is preferably connected to the profile section 28 for the amortized stop of the door, unrelated to the subject matter of this application and protected by another property filed by the same applicant. Said wall is shown with 26 in FIGS. 4, 4A, 5, 5A, 6, 6A. The profile section 28, of the known type and having a substantially "L"-shaped section, is constrained by screws or equivalent means to the front side of the door 24 facing the wall 26 and is abutted to a lowered portion formed at the upper edge of the same door 24, as can be seen in particular in FIG. 5A.

On the first body 12, in correspondence of its rear side facing the second body 14 provided with the two substantially cylindrical appendages 16 and 18, two recesses 16' and 18' are formed, having a semicircular profile section complementary to that of the appendages themselves; the latter are provided with a passing-through hole 32, developed vertically. In each of the holes 32 of the appendages 16 and 18 a cylindrical body is entered, along which an offset and passing-through hole 36 is provided, vertically extended to form as many eccentrics 34 as a whole; the hole 36 of the eccentrics 34 is at least partly threaded to allow screwing in them, starting from the top, of a threaded stem or screw 38, along which two threaded areas interspersed with a portion 40 without threading are created. The lower threaded area of the stems 38, shown in FIGS. 1 and 2 with 42, is screwed into the holes 36 of the respective eccentric 34; the upper threaded area of said stems 38, shown with 44 in the same figures, remains protruding from the holes 36 and on it a nut 46 is screwed with a washer 48, for locking the first body 12 and the second body 14 once paired, as specified below. On the upper header projecting from the eccentrics 34, the stems 38 are provided with a shaped recess, for example of a hexagonal shape, for an operating key.

The appendages 16, 18 projecting from the second body or rear body 14 are intended to be fitted in the recesses with a substantially semicircular profile section 16' and 18' of the first body or front body 12, as shown in FIG. 2, to ensure that said bodies 12 and 14 can approach and arrange in close contact with each other; their stable constraint is achieved by means of the screws 38 screwed into the eccentrics 34, which are entered in the holes 32 of the rear body 14. On the upper side of the front body 12, in correspondence with said appendages 16 and 18, there are as many slots 32' extended horizontally, which align themselves with the holes 32 of the appendages 16, 18 and thus place the same front body 12 in communication with the rear one 14.

On the opposite lower side of said body 12 corresponding slot 32" (as in FIG. 2) are made, aligned with the aforementioned slots 32' formed on the upper side of the body itself.

The screws 38, screwed into the holes 36 of the eccentrics 34 provided in the recesses 16' and 18' of the front body 12, provide for a stable connection between the latter and the rear body 14.

Starting from the lower side of each eccentric 34, a safety screw 50 is screwed into the respective hole 36, which is visible in FIG. 1, intended to contact the eccentric and suitable to prevent an accidental transversal displacement thereof, in the direction of the rear body 14; the screw 50 is screwed into the eccentric 34 starting from the aforementioned slots 32". Both on the front body 12 and on the rear body 14 there is a plurality of passing-through holes or slots 52 aligned with each other, for the insertion of as many screws 54 intended to engage in the relevant expansion plugs 56 previously engaged in the wall 26, as shown in FIG. 4A and, in part, in FIG. 5A. Through said screws 54 and plugs 56, the carriage or slider 10 formed by the coupled front body 12 and rear body 14 is fixedly connected to the wall 26.

To compensate for any unevenness and to make the door 24 perfectly parallel in relation to said wall at each point, the adjustment of the distance of the carriage or slider 10 with respect to the wall 26 is achieved by acting on the eccentrics 34, through the screw 38 screwed into the offset hole 36; the carriage or slider 10 is previously assembled in its two components, i.e. the front body 12 and the rear body 14. This assembly is accomplished by inserting the eccentrics 34 into the holes 32 of the rear body 14, through the approach and contact between substantially cylindrical appendages 16, 18 and the corresponding recesses 16', 18' of the body 12 and by inserting the screws 38 in the holes 36 starting from the slots 32' made on the upper face of the same body 12, as well as by inserting into the lower slots 32" of the body 12 the heads of the screws 50, so as to prevent them from protruding from the lower side of said body 12. Each nut 46 is also screwed onto the upper threaded area of the respective screw 38, with interposition of the washer 48 and, at that point, the fully assembled slider or carriage 10 can be fixed to the wall 26 by means of the screws 54 and the relevant expansion plugs 56 (FIG. 4A).

Figure 8:
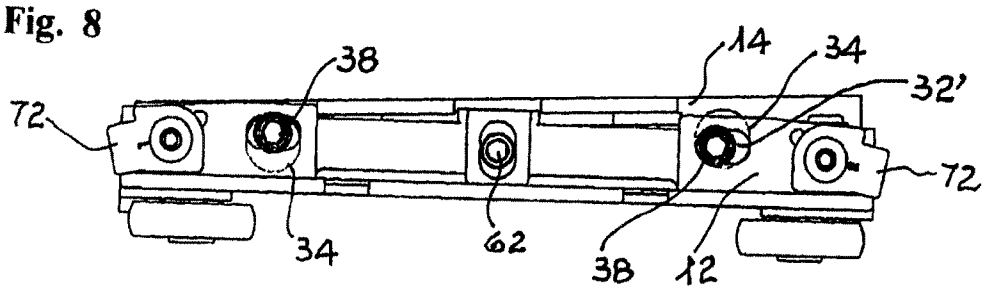
FIG. 8 shows schematically the condition of the carriage or slider following the compensatory intervention carried out on its side with said operating keys.
Figure 9:
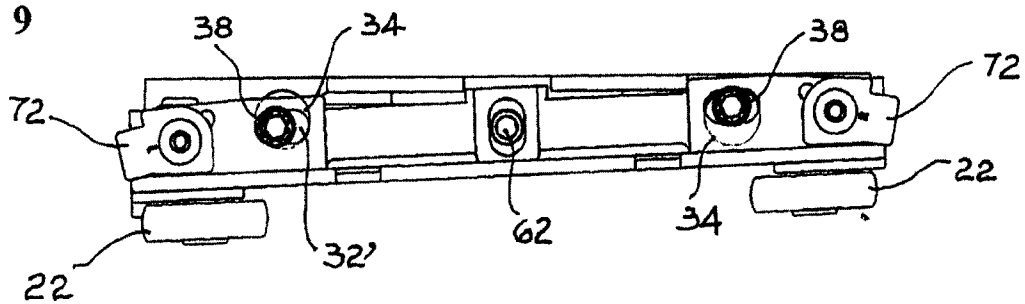
FIG. 9 shows schematically the condition of the carriage or slider following the compensatory intervention carried out on the opposite side with said operating keys.

After hooking the door 24 through the profile section 28 to the wheels 22 of the carriage 10, a condition may arise such as that shown in FIGS. 6 and 6A, with a misalignment leading the door 24 to appear on a side appreciably offset from the wall 26 due to a localized depression, while on the other side it is aligned with the wall itself; the adjustment is then achieved by means of the eccentrics 34, with the following modes. With reference to FIG. 7, the nut 46 of one of the stems 34 is loosened with a hexagonal key 68, while with a male hexagonal key 70 entered in the head of the screw 38 the screw is moved to drive the eccentric connected thereto to rotate, so as to drive the front body 12 of the carriage or slider 10 to move away from the rear body 14. The movement is carried out in such a way as to move the front body 12 away from the rear body 14, then from the wall 26, by bending it forward until it is aligned along the entire length of the wall. The operation can be advantageously carried out even after the definitive securing of the carriage or slider 10 to the wall 26 with the screws 54 and with the door hanging on the bearings or rollers 22; in fact, the front body 12 and the rear body 14 are connected to each other by means of the stems 38, while only the rear body 14 is fixedly secured to the wall 26 by means of the screws 54. This is because the holes 52 bored on the body 12 are sized so as to allow the heads of the screws 54 to pass, by means of which only the aforesaid rear body 14 is secured to the wall 26. It follows that said front body 12 and rear body 14 can move with respect to each other due to the rotation of the eccentrics 34. Once the adjustment has been made, the nut 46 is tightened again. FIGS. 8 and 9 show as many examples of deviation of the front body 12 with respect to the rear body 14, thus highlighting the position which one or the other of the eccentrics 34 assumes following the rotation set with the male hexagonal key 70. The deviations can be compensated in an extremely precise manner, given the possibility of performing a calibrated rotation of one, of the other or possibly of both the eccentrics 34.

Figure 13:
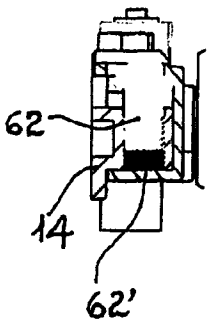
FIGS. 12 and 13 show schematically as many operating conditions of the carriage or slider as a result of its vertical movement according to two alternative hypotheses.
Figure 12:
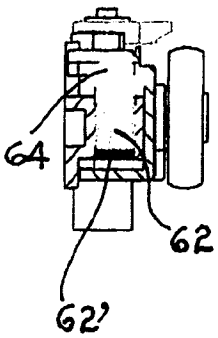
Figure 11:
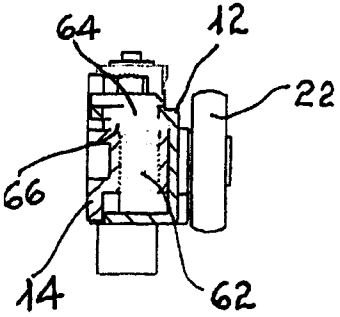
FIG. 11 shows schematically a partially sectioned end view of the carriage or slider, to highlight the means that allow it to be adjusted vertically, to also allow the optimum sliding of the door along the known guide secured to the floor.
Figure 10:
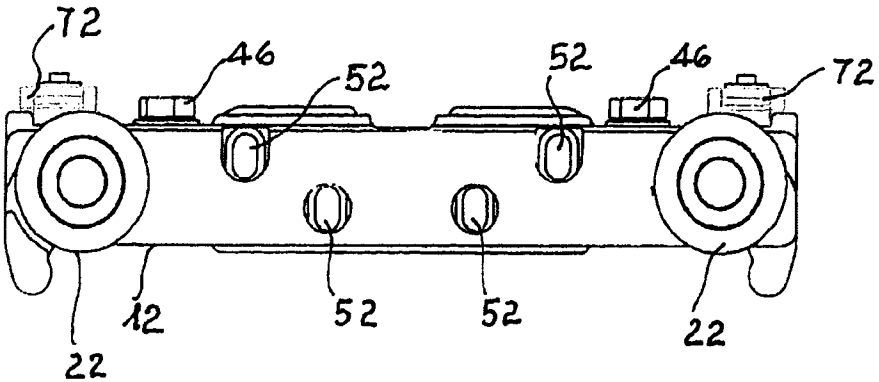
FIG. 10 shows schematically the carriage or slider according to a side view from the front side, to highlight the pair of wheels or rollers with which it is conventionally provided.

According to a further advantageous feature of the invention, the device 10 comprises, on the rear body 14, a third protruding substantially cylindrical appendage 58, similar to the first two cylindrical appendages 16, 18 and centrally positioned with respect to them; in parallel, on the rear side of the front body 12 a third recess is formed with a substantially semicircular profile section 58', visible in FIG. 2. The third cylindrical appendage 58 is provided with a hole 60 developed vertically and at least partly threaded in which a screw 62 is screwed in order to adjust the carriage or slider 10 vertically, i.e. with respect to the floor to which the known guide is secured for the movement of the door along the lower edge. On the upper front of the front body 12, as can be seen in particular in FIGS. 1 and 7, in correspondence with the substantially cylindrical appendage 58 similar to the two appendages 16, 18, a hole or slot 60' that aligns with the hole 60' of the third substantially cylindrical appendage 58 is made. The head 64 of the screw 62 is provided with a shaped recess, for example hexagonal, for an operating key. Below said head 64, the screw 62 carries a solid washer 66, designed to abut the upper side of the body 12 when said screw 62 is completely screwed into the hole 60'. At that point, the further rotation of said screw, which also engages with the threading created partly along the rear body 14 and shown with 62', causes the front body 12 to be raised or lowered with respect to the rear body 14, as schematized in FIGS. 11 to 13, thus allowing to adequately spread the load due to the weight of the door 24, distributing it between the wheels 22 of the carriage 10 and those (not shown) combined with the guide for moving the door along the lower edge; in this way, the sliding as much as possible fluid of said door as a whole is obtained.

At the opposite ends of the carriage or slider 10, on the upper side of the front body 12, an adjustable stop 72 is arranged, designed to prevent the door 24 from sliding out of the rollers 22 of the carriage or slider 10; such slippage, which would cause the shaped portion 22' of the profile section 28 to climb over said rollers 22, could occur in the event of accidental jerks of the same door 24 during its sliding. The opposite orientable stops 72, therefore, are positioned so as to prevent the section 28 from rising too high, bringing its shaped portion 22' coupled to the rollers 22 of the slider 10 to bypass the rollers themselves; the advanced part or beak 72' of the same stops 72 is in fact appropriately oriented so as to be directly above the rollers 20, at a minimum distance from them, which excludes any possibility of slippage.

As can be seen from the foregoing, the advantages that the invention achieves are evident.

The sliding device for doors of this invention allows to accurately align the door 24 to the wall 26, thanks to the presence of the eccentrics 34 that allow a micrometric adjustment; particularly advantageous is the possibility of carrying out this adjustment without the need to disassemble the already installed door 24. Moreover, the sliding device of the invention allows a similar adjustment in the vertical direction of the carriage or slider 10, so as to allow said door an optimum sliding also along the traditional lower guide secured to the floor. Finally, as specified above, said sliding device can be used, in addition to the doors, also for wardrobe doors and for furniture storage units in general; in this case, the device can be secured to a suitably sized shelf of the wardrobe or of the piece of furniture.

Although the invention has been described above with reference to a possible embodiment thereof, given by way of non-limiting example, numerous changes and variations will be apparent to a person skilled in the art in light of the above description. This invention, therefore, intends to embrace all changes and variations that fall within the spirit and in the protective scope of the following claims.

The invention claimed is:

1. A sliding device for doors (24) provided with multiple adjustments consisting of a carriage or slider (10) provided with rollers or bearings (22), comprising a profile section (28) with a substantially "L"-shaped section, constrained to the front side of the door (24) facing a wall (26) on which a passage area (30) is created, abutted to a lowered portion formed at the upper edge of the same door (24) and provided with an embossed and shaped portion (22') having a shape complementary to the profile section of the rollers along which it slides, characterized in that the carriage or slider (10) comprises a first body or front body (12), having a substantially rectangular plan, and a second body or rear body (14) designed to be connected to the first front body (12) and provided with opposed first and second substantially cylindrical appendages (16, 18) with a vertical passing-through hole (32) in which respective cylindrical bodies are inserted along which an offset and passing-through threaded hole (36) is bored, to form as many eccentrics (34), in each of said holes (36) being inserted a threaded stem or screw (38) that protrudes from the upper side of the front body (12) on which corresponding slots (32') are made.

2. The sliding device according to claim 1, characterized in that each stem (38) comprises a lower threaded area (42), which is screwed into the hole (36) of the respective eccentric (34), and an upper threaded area (44), which protrudes from said slots (32') made on the upper side of the front body (12), said lower (42) and upper (44) threaded areas being interspersed with a portion (40) without threading.

3. The sliding device according to claim 2, characterized in that on the lower side of the first body (12) there are slots (32") aligned with the slots (32') created on the upper side of the same body (12).

4. The sliding device according to claim 2, characterized in that on the upper threaded area (44) of the stem (38) projecting from said slots (32') a nut (46) is screwed with interposition of a washer (48).

5. The sliding device according to claim 2, characterized in that from the lower side of each eccentric (34) a safety screw (50) is screwed into the respective hole (36) to prevent accidental transversal displacement of the eccentric itself.

6. The sliding device according to claim 5, characterized in that each safety screw (50) is screwed into the eccentric (34) starting from a slots (32"), formed on the lower side of the front body (12) and aligned with the slots (32') created on the upper side of the same body (12).

7. The sliding device according to claim 1, characterized in that the first body (12), in correspondence of its rear side facing the second body (14), is provided with two recesses (16', 18') with semi-circular profile section complementary to that of the two substantially cylindrical appendages (16, 18) of said rear body (14).

8. The sliding device according to claim 1, characterized in that the rear body (14) comprises a third projecting substantially cylindrical appendage (58), centrally positioned with respect to the first and second cylindrical appendages (16, 18) and provided with a hole (60) at least partly threaded for a screw (62) on the head of which (64) a recess is formed shaped for an operating key and below said head (64) the same screw (62) carries an integral solid washer (66) designed to abut the upper side of the front body (12), on the rear side of the front body (12) being formed in parallel a recess with a substantially semicircular profile section (58').

9. The sliding device according to claim 8, characterized in that the screw (62) cooperates with a threaded area (62') created along the rear body (14).

10. The sliding device according to claim 9, characterized in that the head (64) of the screw (62) protrudes from a hole or slot (60') formed on the upper side of the front body (12).

11. The sliding device according to claim 10, characterized in that at the opposite ends of said upper side of the front body (12) there is an adjustable stop (72), designed to avoid the door (24) from overriding the rollers (22) of the carriage or slider (10).

12. The sliding device according to claim 1, characterized in that a plurality of passing-through holes or slots (52) aligned with each other are provided on the front (12) and rear (14) bodies for the insertion of the same number of screws (54) designed to engage in the relevant expansion plugs (56) previously inserted into the wall (26) to secure to the wall itself the rear body (14), the holes or slots (52) created on the front body (12) and being sized so as to allow the passage of the head of said screws (54).

* * * * *